United States Patent [19]

Willetts

[11] Patent Number: 4,611,480

[45] Date of Patent: Sep. 16, 1986

[54] METALLIC WALL HAVING KNOCKOUTS AND METHOD OF FORMING

[75] Inventor: Charles A. Willetts, East Hazel Crest, Ill.

[73] Assignee: Allied Tube & Conduit Corporation, Harvey, Ill.

[21] Appl. No.: 599,490

[22] Filed: Apr. 12, 1984

[51] Int. Cl.[4] ..... B21D 31/02

[52] U.S. Cl. ..... 72/326; 52/100; 52/516; 52/735; 228/151

[58] Field of Search ..... 52/98, 100, 735, 514–516, 52/632, 815, 743; 220/265; 72/326, 327; 228/151

[56] References Cited

U.S. PATENT DOCUMENTS

| | | | |
|---|---|---|---|
| 2,114,289 | 4/1938 | Draim | 52/515 |
| 3,266,051 | 8/1966 | Attwood | 52/100 |
| 3,580,122 | 12/1968 | Powell | 83/108 |
| 3,827,139 | 8/1974 | Norteman | 228/151 |

FOREIGN PATENT DOCUMENTS

| | | | |
|---|---|---|---|
| 1181683 | 6/1959 | France | 52/98 |
| 998190 | 7/1965 | United Kingdom | 52/98 |

*Primary Examiner*—Carl D. Friedman
*Assistant Examiner*—Naoko N. Slack
*Attorney, Agent, or Firm*—Fitch, Even, Tabin & Flannery

[57] ABSTRACT

An elongated wall formed substantially of metallic material. The wall includes a first surface and a second surface spaced from the first surface. A plurality of spaced knockout portions are disposed in incipient apertures extending through the wall and these knockout portions are adapted to be selectively removed from the remainder of the wall by application of force to the portion to be removed. This force could be applied as by subjecting the knockout to a sharp blow directed to the portion. Each knockout portion so completely fills its corresponding aperture as to render the wall substantially impervious to the passage of fluid. The wall further comprises a coating applied to one of its surfaces. A method of forming the wall is also disclosed.

2 Claims, 12 Drawing Figures

METALLIC WALL HAVING KNOCKOUTS AND METHOD OF FORMING

BACKGROUND OF THE INVENTION

The present invention relates to metallic structural members and, more particularly, to such a member having a plurality of spaced apertures filled by knockout portions permitting mounting of the item(s) to be supported at a variety of locations along the member.

It is common in the manufacture of sign posts and the like to provide one or more series of regularly spaced mounting apertures along the length of the post. This permits convenient field installation of the sign on the post after the post has been set. It thus avoids the need for drilling apertures in the field and even removes the need for the installer to decide at what point along the post the sign is to be mounted, until after the post is set.

When such posts are manufactured by a continuous rolling mill, the apertures must be provided as an additional manufacturing step performed either before or after the tube formation process. In the typical continuous rolling process for forming tubing without apertures, flat stock is transversely bent until the lateral ends are brought into abutment and welded together to form a tube. The formed tube is then subjected to alkali wash, water rinse and pickling steps to remove dirt, grease and other contaminants prior to drying in preparation for galvanization of the outside surface of the tube by passing the tube through a molten zinc bath. The flat stock cannot be provided with the apertures prior to tube formation and still retain the galvanization step after tube formation because the wash, rinse and pickling liquids would have access to the inside of the formed tube where they could not be effectively removed prior to galvanizing. The entrance of such cleansing liquids into the molten zinc bath could have catastrophic consequences. Not only would the zinc bath be contaminated, but water and molten zinc are an explosive combination. Thus the flat stock is either galvanized prior to punching the apertures and the tube formation process occurring without the typical galvanization step; or the tube is formed in the above-described typical manner with the apertures formed in the tube off-line as a last manufacturing step.

It is common that no additional corrosion protection is applied after the series of mounting holes is drilled in a length of pipe. Thus, the material defining these apertures is bare metal and has no protective coating. The aperture used to mount the sign is somewhat shielded from the elements by the presence of the sign and the mounting fastener. However, the remaining apertures, available but unused, represent easy targets for the onset of rust. Rust not only makes the post unsightly, but it progressively weakens the post until the point where the post is structurally insufficient and must be replaced. Rusting continues under normal environmental conditions and under extreme conditions, such as the splashing of salt water on the posts by passing vehicles, the rusting process is greatly accelerated.

Apart from the oxidation problem, the provision of a series or multiple series of apertures in the post also results in a significant reduction of the load-carrying ability of the post. This is particularly true when the post is used as a horizontally disposed, load-carrying member. With the use of so many holes, thicker gauge stock is required to obtain a given load rating.

SUMMARY OF THE INVENTION

Among the several aspects of the present invention may be noted the provision of an improved metallic structural member for holding an object and a method of manufacturing that member. The structural member provides for simplified mounting of the object without the need for drilling mounting holes in the field, and allows the installer to set the structural member prior to identifying the precise mounting location. Another objective of the present invention is to provide the structural member with increased corrosion resistance and better appearance, increased load-carrying capability and longer service life. The method of the present invention permits a tube having knockout portions to be formed and galvanized on a continuous tube mill. Other objects and features of the present invention will be, in part, apparent and, in part, pointed out hereafter in the specification and attendant claims and drawings.

Briefly, the wall of the present invention includes a first surface and a second surface spaced from the first surface. A plurality of knockout portions are disposed in incipient apertures extending through the wall and these knockout portions are adapted to be selectively removed from the remainder of the wall by application of force to the portion to be removed. Each knockout portion so completely fills its corresponding aperture that the wall is rendered substantially impervious to the passage of a fluid. The wall further comprises a coating applied to one of its surfaces.

As a method of providing a length of metallic material with a plurality of spaced knockout portions, the present invention includes several steps. First a generally flat length of the metallic material is struck with a cutting punch means for forming in the length one or more lines of cleavage to at least partially define the knockout portion. The knockout portion thus formed is displaced, at least partially, from the remainder of the length of material. Sufficient forces are applied to opposing surfaces of the knockout portion and the flat length of material to move the knockout portion toward the flat length sufficiently to close any openings therebetween. These steps of striking, displacing and applying forces are repeated until formation of the desired number of knockout portions is effected.

BRIEF DESCRIPTION OF THE DRAWINGS

Corresponding reference characters indicate corresponding components throughout the several views of the drawings.

DESCRIPTION OF THE PREFERRED EMBODIMENT

Figure 2:
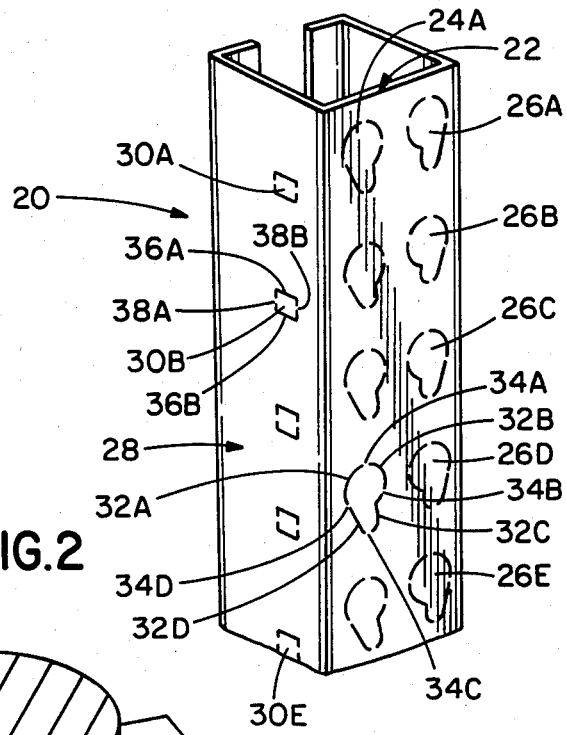
FIG. 2 is a perspective view of a length of channel formed in accordance with the present invention which corresponds to the prior art channel of FIG. 1 in that it has knockout portions which can be selectively removed to provide apertures substantial identical to those of the prior art channel.

Referring now to the drawings, a structural member of the present invention is generally indicated in FIG. 2 by reference character 20. Member 20 is a channel-shaped metallic post having a front wall or web 22 provided with a number of knockout portions 24A–E and 26A–E, and a side wall or flange 28 having a plurality of spaced knockout portions 30A–E. Each knockout portion is generally coplanar with the wall retaining it, and each knockout portion is defined by lines of cleavage and is attached to surrounding material by tabs. For example, comma-shaped knockout portion 24E is defined by lines of cleavage 32A–32D and is attached to surrounding material by tabs 34A–34D. Similarly, rectangular knockout portion 30B is defined by lines of cleavage 36A, B, and is connected to surrounding material by interconnection tabs 38A, B. Each knockout portion can be considered to occupy an incipient mounting aperture and a predetermined aperture can be opened by applying force to the knockout portion as by hitting with a hammer a punch centered on the knockout portion.

Figure 1:
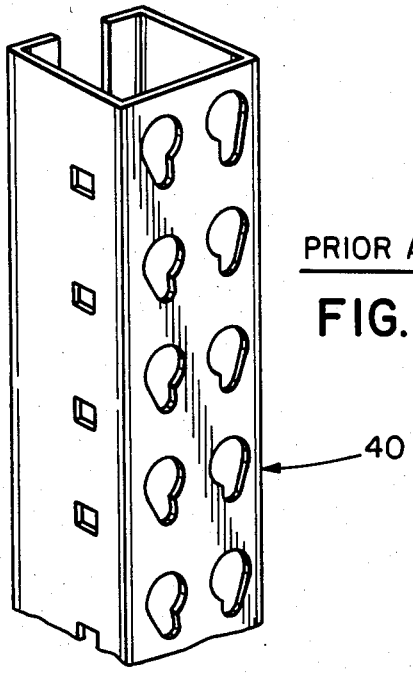
PRIOR ART FIG.1
FIG. 1 is a perspective view of a length of prior art channel having a plurality of mounting apertures of various shapes.

It is easily discernable that member 20 is the equivalent of prior art mounting post 40 shown in FIG. 1. That is, member 20 and post 40 have corresponding mounting locations. These are the apertures in post 40 and the incipient apertures in member 20 filled by the knockout portions. In fact, structural member 20 could be transformed into post 40 by simply removing all the knockout portions. This would be undesirable because member 20, having its apertures filled, has greater beam and column strength than post 40. Furthermore, as will be explained more fully hereinafter, with post 40 it is typical that a corrosion protective coating would not be applied to the strip from which post 40 is formed, after the apertures are punched. Thus the apertures are defined by bare metal, typical steel. This allows the rusting process to commence almost immediately. With structural member 20, however, the apertures are effectively plugged by the knockout portions. Only after a knockout portion is removed in preparation for mounting is bare metal exposed. And then the bare metal defining the exposed aperture is somewhat shielded from the elements by the presence of the mounted object and the mounting fastener extending through the aperture. An additional advantage of structural member 20 is that the plugged apertures do not have sharp exposed edges which could cut the installer's fingers.

Figure 3:
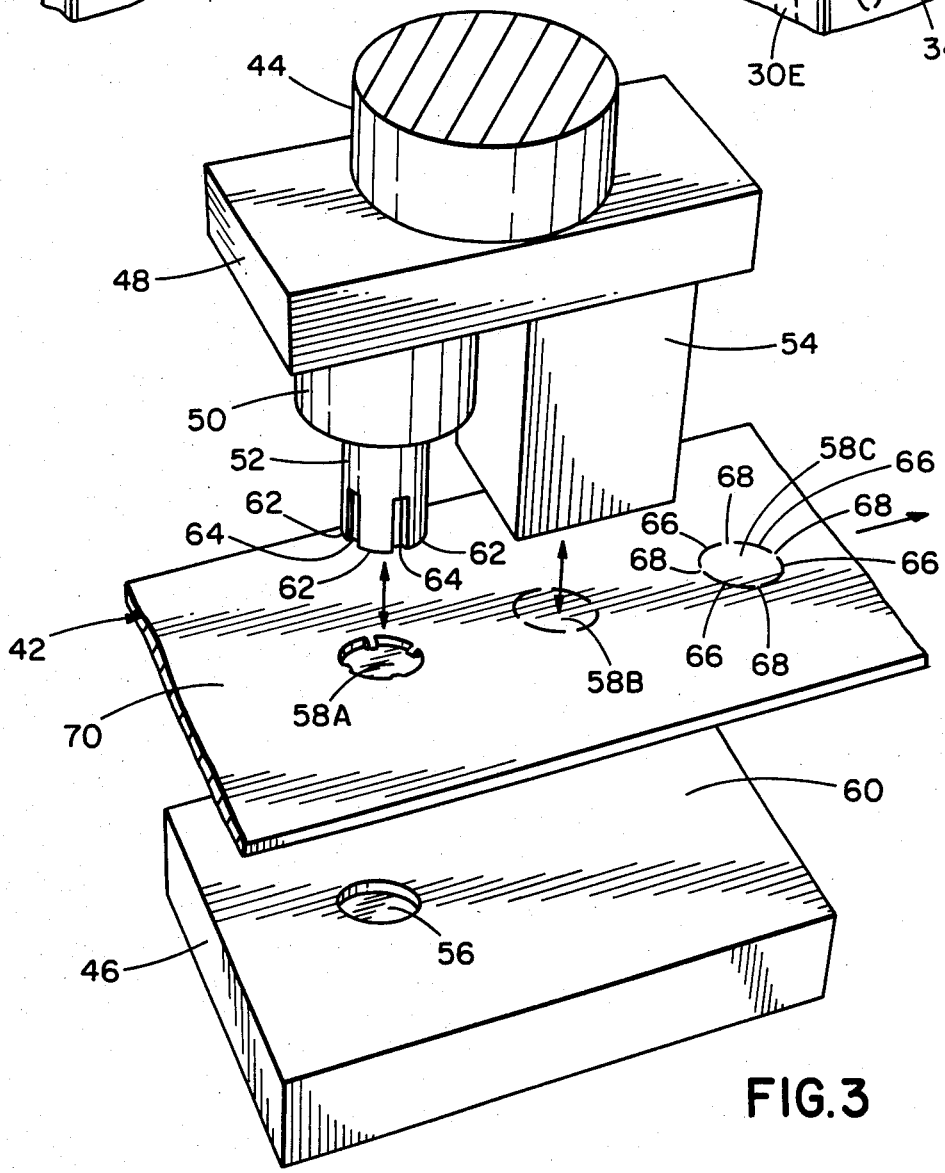
FIG. 3 is a perspective view of certain components of a simplified progressive die arrangement for use in forming circular knockouts, in accordance with the present invention, in a substantially flat length of metallic material, which die first cuts and partially displaces the knockout and then replaces the knockout in the flat length.

Referring to FIG. 3, certain components of a simplified progressive die arrangement are shown for providing circular knockout portions in a flat strip 42 of metallic material. The arrangement includes reciprocal press means (not shown) and drive means (also not shown) for advancing strip 42 in stepwise fashion in the direction of the arrow in synchronization with operation of the press means. Such press means and drive means are well known to those of skill in the art and need not be further described. Attached to the press means is a fixture comprising a rod 44 affixed to the ram of the press for undergoing reciprocal movement therewith relative to a table 46 held by the press bed in precise alignment with rod 44. The rod 44 supports a block 48 dependent from which is a chuck means 50 holding a cutting punch 52. Disposed spaced upstream relative to punch 52 is a presser foot 54 also dependent from block 48 and which terminates somewhat short of the punch. The table 46 has a die nest 56 disposed in alignment with punch 52 for receiving a displaced knockout 58A. The table 46 also has an upstream anvil 60 for cooperation with the presser foot 54 to replace a knockout portion 58B in the plane of strip 42.

The cutting punch 52 has a plurality of cutting edges 62 with adjacent edges spaced by vertically extending reliefs 64. The cutting edges 62 form the lines of cleavage 66 defining a knockout while the presence of the reliefs results in retention of interconnecting tabs 68.

Figure 4:
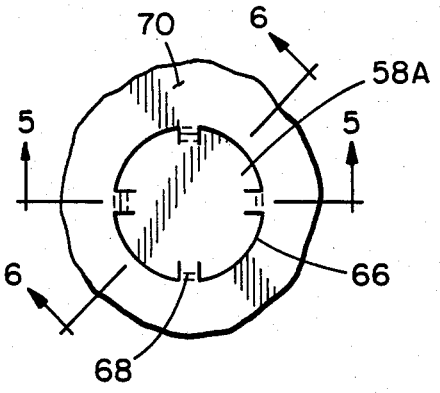
FIG. 4 is a plan of the circular displaced knockout of FIG. 3, which is attached to surrounding material by a plurality of regularly spaced interconnecting tabs.
Figure 5:
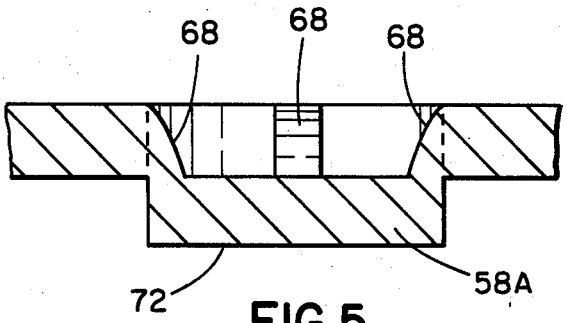
FIG. 5 is a sectional view taken generally along line 5—5 of FIG. 4 through a pair of diametrically opposed tabs.
Figure 6:
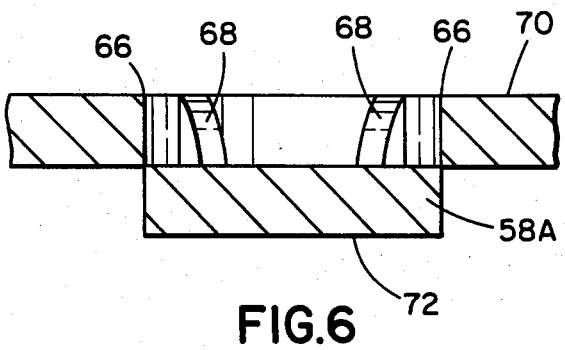
FIG. 6, similar to FIG. 5, is a sectional view taken generally along line 6—6 of FIG. 4 between adjacent tabs.
Figure 7:
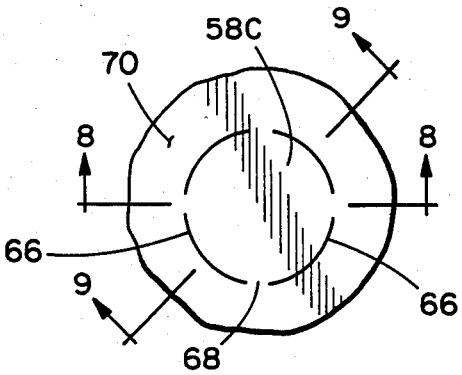
FIG. 7 is a plan of the circular replaced knockout of FIG. 3.
Figure 8:
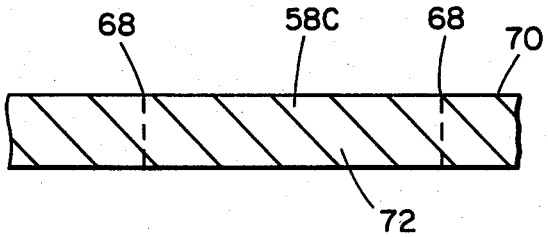
FIG. 8 is a sectional view taken generally along line 8—8 of FIG. 7 through opposed tabs.
Figure 9:
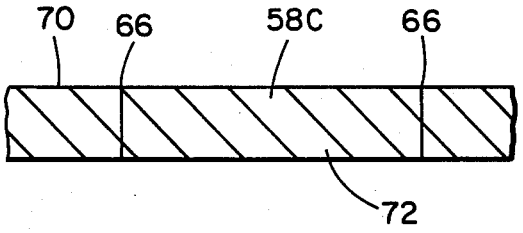
FIG. 9, similar to FIG. 8, is a sectional view taken generally along line 9—9 of FIG. 7 showing lines of cleavage which define the replaced knockout.

Operation of the progressive die arrangement is as follows: Extension of the ram of the press results in the cutting punch 52 striking the flat strip 42 to form the lines of cleavage 66 and to displace the knockout portion 58A, best shown in FIGS. 4–6, from the plane of strip 42 with the knockout being attached to the surrounding strip material by interconnecting tabs 68. As the ram moves to its retracted position, the drive means functions to lift knockout 58A from the nest 56 and advance the strip 42 in the direction of the arrow in FIG. 3 until knockout 58A becomes positioned between the presser foot 54 and the anvil 60. The flat strip 42 has an upper surface 70 while the displaced knockout portion 58A has a lower surface 72. The drive means holds the knockout portion 58A in position under the presser foot 54 as the press ram moves toward its extended position causing the knockout portion lower surface 72 to be engaged by anvil 60 and the strip surface 70 surrounding the knockout portion to be engaged by the presser foot. Movement of the ram to its fully extended position results in the application of sufficient forces to surface 70 of the strip and opposing surface 72 of the knockout portion to result in reinsertion of the knockout portion in the plane of the strip and closure of any opening between the knockout portion and the remainder of the strip to prevent passage of a fluid therebetween. The drive means thereafter advances the strip 42 in stepwise fashion in concert with reciprocal operation of the press means until formation of the desired number of knockout portions is completed.

Figure 10:
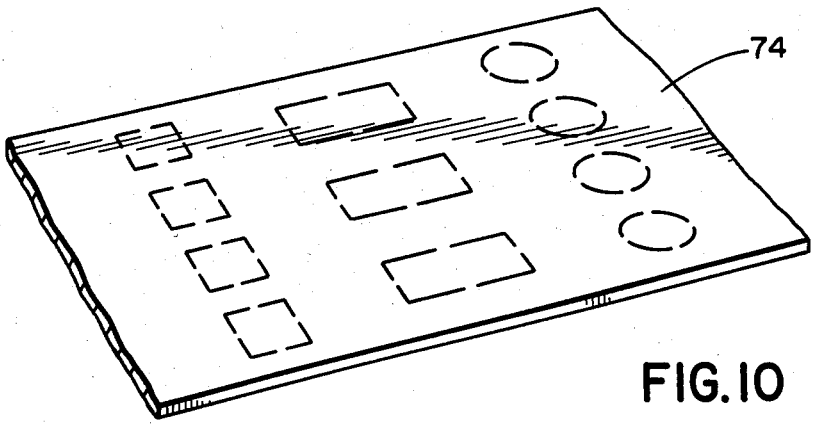
FIG. 10 is a perspective view of a flat strip of metallic material having an array of knockout portions of various shapes.

While the components of the simplified progressive die means just discussed only form a single displaced knockout portion per ram stroke, it will be apparent to those of skill in the art that the block 48 can carrying a plurality of cutting punches of various shapes. Furthermore, the presser foot 54 and anvil 60 can cooperate to reinsert a number of knockout portions, such as formed in strip 74 as shown in FIG. 10, with each extension of the ram.

As is known to those of skill in the metal working art, the cutting of metal results in a slight expansion of the material along the line of cleavage due to the ductility of the metal. Thus the displaced knockout portion 58A has a slightly greater area than the aperture it vacated. Accordingly, reinsertion of the knockout portion into the aperture is often sufficient to close any opening between the knockout portion and the surrounding material to make the strip impervious to the passage of a fluid. However, the strip, with the knockout portions reinserted, could be passed between compression rollers to further expand the knockout portions to place them in a yet tighter fit in their corresponding apertures. Such compression rollers could also be used to replace displaced knockout portions into the plane of the strip.

As a method, the present invention includes several steps:

(A) A generally flat length of metallic material is struck with cutting punch means for forming one or more lines of cleavage to at least partially define a knockout portion.

(B) The knockout portion is displaced, at least partially, from the remainder of the flat length of material.

(C) Sufficient forces are applied to opposing surfaces of the knockout portion and the flat length of material to move the knockout portion toward the flat length so as to close any openings therebetween to prevent the passage of a fluid between the knockout portion and remainder of the strip.

(D) The aforementioned steps of striking, displacing and application of forces are repeated until formation of the desired number of knockout portion is completed.

Figure 11:
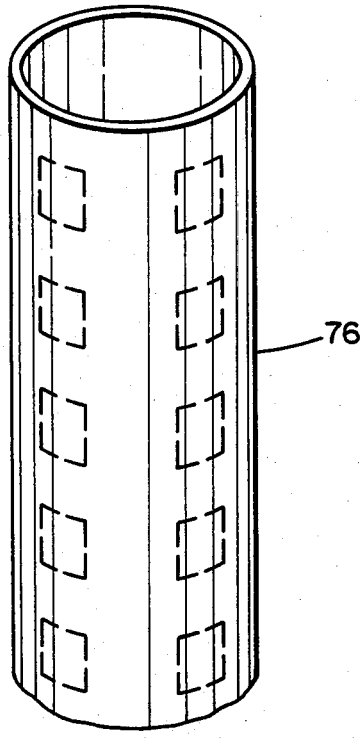
FIG. 11, similar to FIG. 2, shows a length of tubing of generally circular cross section formed in accordance with the present invention.
Figure 12:
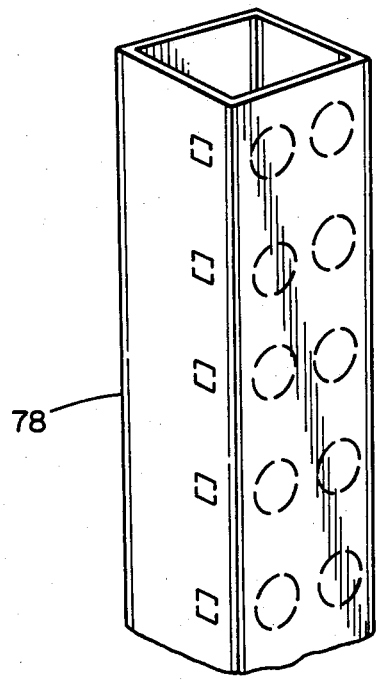
FIG. 12, also similar to FIG. 2, depicts a length of tubing of rectangular cross section formed in accordance with the present invention.

This process of forming knockout portions in a strip of metallic material is particularly conducive for use with a continuous rolling mill for forming the strip into a closed wall tube of either circular or rectangular cross section. A closed wall tube 76 of circular cross section is shown in FIG. 11 while a closed wall tube 78 of rectangular cross section is shown in FIG. 12, both tubes being formed in accordance with the present invention. A continuous rolling mill functions to transversely bend the strip until the lateral ends are brought into abutment and they are welded together to form a closed wall. Thereafter, dirt, grease and other contaminants are removed from the formed tube by washing it, for example, by an alkali solution, and then subjecting the tube to a water rinse. Pickling fluid may then be sprayed on the tubing and a further rinse is used. Subsequent to the drying of the tube, corrosion protection is provided by passing the tube through a molten zinc bath for galvanizing the tube. Such a continuous rolling mill is described in commonly assigned U.S. Pat. Nos. 3,122,114 and 3,259,148, the teachings of which are hereby incorporated by reference. Additionally, the inside surface of the tubing can be coated shortly before or after the welding step as shown in commonly assigned U.S Pat. No. 3,768,145, the teachings of which are also hereby incorporated by reference.

In the prior art, the flat strip was galvanized prior to punching the apertures. Thereafter, the strip could be formed into a tube in a manner similar to that described above except the galvanization step could not be employed. This step was precluded because, since the tube had apertures, the wash and rinse liquids would get inside the tube where they could not be effectively removed. If the galvanization step was included, the molten zinc bath would become contaminated quickly, and the pairing of water and molten zinc results in an explosive combination.

With the present invention, a strip having the reinserted knockout portions could be formed in a continuous rolling mill process including the steps of galvanization and coating the inside of the tubing. These steps are permitted because liquids, which are applied to the outside surface of the formed tube during the washing and rinsing, do not have access to the center of the tubing where they could contaminate the inside coating because the wall forming the tubing is impervious to the passage of fluid. Thus, the liquids could be removed by wiping and/or drying prior to the tubing reaching the molten zinc bath, just as in the formation of a solid wall tube without the provision of knockout portions.

The formation of the knockout portions in the strip could be completed off-line and the strip recoiled for use in the continuous roll forming mill process. On the other hand, the knockout portions could be provided on-line as a first step in the continuous roll forming process. In the latter case, an accumulator, such as shown in U.S. Pat. Nos. 3,122,114 and 3,259,148 would be required because the strip must be held stationary when the punch means enters and leaves the plane of the strip. At other times, the progressive die drive means could advance the strip into the accumulator at sufficient speed that the accumulator could provide a constant output at the same feed rate as used by the continuous rolling mill.

The knockout formation method can be used with both strips of ferrous and non-ferrous metals. Furthermore, various other decorative or corrosion preventive coatings can be applied to the tubing during the roll forming process. Also, since the flat stock is substantially smooth after formation of the knockout portions, prefinished material can be provided with the knockout portions.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A method of fabricating, from flat strip steel, galvanized tubing having a plurality of spaced knockout portions adapted for selective removal by the application of force to the portion to be removed, such as by applying a sharp blow to that portion, said method comprising the following steps:

forming the knockout portions in said flat strip, each portion being defined, at least partially, by a plurality of lines of cleavage so that each knockout portion is attached to surrounding material by tab means, the forming step being carried out so that the passage of a fluid between the knockout portions and the remainder of said strip is precluded;

transversely bending said strip until the lateral ends thereof abut;

continuously welding said lateral ends together to form a tube;

applying liquids to the outside surface of said tube to remove contaminants therefrom;

rinsing the outside surface of said tube with water;

drying the outside surface of said tube; and galvanizing the outside surface of said tube by passing said tube through a molten zinc bath, said step of forming knockout portions comprising the following substeps:

striking said flat strip steel with cutting punch means for forming in said strip a plurality of lines of cleavage at least partially defining a knockout portion;

displacing said portion, at least partially, from the remainder of said strip;

applying sufficient forces to opposing surfaces of said knockout portion and said strip to move said knockout portion toward said strip and to close any opening therebetween to prevent the passage of a fluid between said knockout portion and said remainder of said strip; and repeating the aforementioned steps of striking, displacing and applying until formation of the desired number of knockout portions is completed, said steps of bending, welding, application of liquids, rinsing, drying and galvanizing being performed in a continuous rolling mill production line, said step of forming the knockout portions being completed off said production line with the strip being coiled after said forming step.

2. The method as set forth in claim 1 further comprising the step of applying a protective coating to the inside of said tube, the last-mentioned step to be performed prior to the step of applying liquids to the outside tube surface.

* * * * *